US007320161B2

(12) United States Patent
Taylor

(10) Patent No.: US 7,320,161 B2
(45) Date of Patent: Jan. 22, 2008

(54) LACES TYING DEVICE

(76) Inventor: Supen Taylor, 61 Warleigh Road, Brighton (GB) BN1 4NS ( * ) Notice: Subject to any disclaimer, the term of this patent is extended or adjusted under 35 U.S.C. 154(b) by 0 days.

(21) Appl. No.: 10/540,116

(22) PCT Filed: Dec. 22, 2003

(86) PCT No.: PCT/GB03/05615

§ 371 (c)(1),
(2), (4) Date: Jun. 20, 2005

(87) PCT Pub. No.: WO2004/056227

PCT Pub. Date: Jul. 8, 2004

(65) Prior Publication Data

US 2006/0053601 A1 Mar. 16, 2006

(30) Foreign Application Priority Data

Dec. 21, 2002 (GB) ..... 0229973.3

(51) Int. Cl.
*A43C 7/00* (2006.01)

(52) U.S. Cl. ..... 24/712.2; 24/712.1; 24/712.3; 24/712.5; 24/715.6; 36/50.1

(58) Field of Classification Search ..... 24/712.2, 24/712.3, 712.1, 712.5, 712.6; 36/50.1
See application file for complete search history.

(56) References Cited

U.S. PATENT DOCUMENTS

| | | | | |
|---|---|---|---|---|
| 592,140 | A * | 10/1897 | Gross | 24/712.6 |
| 4,393,550 | A | 7/1983 | Yang et al. | |
| 4,715,094 | A | 12/1987 | Herdman | |
| 5,022,127 | A * | 6/1991 | Ang | 24/712.2 |
| 5,402,589 | A * | 4/1995 | Lubrani et al. | 36/50.1 |
| 5,718,021 | A | 2/1998 | Tatum | |
| 6,178,606 | B1 * | 1/2001 | Glendon | 24/712.5 |

FOREIGN PATENT DOCUMENTS

| | | | |
|---|---|---|---|
| GB | 2 343 701 | A | 5/2000 |
| GB | 2343701 | A * | 5/2000 |

* cited by examiner

*Primary Examiner*—Katherine Mitchell
*Assistant Examiner*—Marcus Menezes
(74) *Attorney, Agent, or Firm*—Lerner, David, Littenberg, Krumholz & Mentlik, LLP

(57) ABSTRACT

A laces tying device comprises a body (2) provided with one or more apertures (3) which receive the ends of a lace to be tied and with readily-releasable fastening means to fasten the ends of the lace in the apertures (3) of the body (2), and clip means (4) comprising a retaining arm mounted on a springloaded hinge provided on the surface of the body (2), the retaining arm serving to retain overlapped portions of the lace which, in use, extend from the apertures (3).

20 Claims, 4 Drawing Sheets

LACES TYING DEVICE

This invention relates to a fastening device for use in particular, but not exclusively, with the laces of a shoe.

Young children can find tying their shoelaces difficult owing to the relative complexity of the knots required, and their limited finger co-ordination. The elderly and disabled may also find it difficult to tie shoelaces or other laces.

Numerous shoelace tying devices have been proposed to overcome this problem. My UK Patent Application No. 2,379,858 discloses a shoe fastening means for a shoe having an upper, the vamp of which is split in conventional manner and is provided with a series of oppositely-disposed lace holes in opposed side edge portions thereof for receiving a shoe lace, opposite ends of this shoelace being received, in use, in a clutch device, characterised in that the clutch device is provided with at least one lace-engaging portion on an outwardly facing portion thereof in use, which outwardly facing portion engages a knotted shoelace to prevent the knot from slippage and the shoelace from becoming untied.

The above-described clutch device is disc shaped and has a disc shaped portion of tenacious elements, hooks, barbs or the like which engage and retain the shoelace. The clutch element holds the shoe laces in a tied position to prevent the shoe from loosening on the wearer's foot. A bow, however, still has to be tied to engage the distal ends of the lace, which is then engaged by the tenacious elements.

The present invention is intended to overcome the problems outlined above.

According to the present invention a laces tying device comprises a body provided with one or more apertures adapted to receive the lace with which the device is used and provided with readily releasable fastening means adapted to fasten the lace in the one or more apertures, and clip means comprising a retaining arm mounted on a spring-loaded hinge provided on the outer surface of the body, said hinge biasing the arm towards the outer surface of the body and the retaining arm being arranged to retain overlapping portions of the lace which, in use, extend from the one or more apertures.

It will be appreciated that the above device can be used with any article provided with laces, for example trousers, dresses, coats and so on. However, in a preferred construction the device may be used with footwear provided with laces.

In one construction the one or more apertures are intersected by a passage, in which is disposed a spring-loaded clamp element. The clamp element may be provided with one or more apertures corresponding to the one or more body apertures. In a preferred arrangement the clamp element is biased so that the one or more clamp apertures and the one or more body apertures are normally disposed out of alignment. The clamp element can be provided with a trigger, which when operated displaces the clamp element to bring the one or more clamp apertures and the one or more body apertures into alignment. With this arrangement, the opposing ends of the lace can be threaded through the one or more apertures of the body and of the clamp element when the trigger is operated, and held in place when the trigger is released.

In one construction a single body and clamp aperture is provided, through which both the opposite ends of the lace are threaded. However, in a preferred construction, two body and two clamp apertures are provided, through which each of the opposite ends of the lace are threaded.

The retaining arm may be provided with lace engaging elements on its underside. Further, lace engaging elements may be provided on the outer surface of the body, adjacent the lace engaging elements provided on the arm.

In a preferred embodiment of the invention, the retaining arm is adapted to retain the lace ends arranged as follows. First the lace ends extending from the apertures are arranged parallel to one another, then they are overlapped at a point approximately half way along their extending length. The point of overlap is then disposed under the retaining arm, which is adjacent the inner ends or bases of the extending lengths of the lace. This results in a bow of traditional appearance being formed, with the device replacing the knot in the centre.

Therefore, the invention also includes a method of using a device as defined above, the method including the steps of:

(a) Operating the releasable fastening means and threading the two opposite ends of the lace through the one or more body apertures, then applying the fastening means to fasten the ends of the lace;

(b) arranging the lace ends extending from the one or more body apertures parallel to one another;

(c) overlapping the lace ends at a point approximately half way along their length;

(d) opening the clip means and placing the point of overlap of the lace ends under the retaining arm; and (e) closing the retaining arm onto the point of overlap of the lace ends.

In line with the above method, the lace engaging elements of the clip means are adapted to retain the overlapped portion of the laces. The lace engaging elements provided on the underside of the arm may comprise elongate projections. In a preferred construction approximately 6 such projections are provided. The projections may extend from the underside of the arm towards the hinge at an angle less than 90 degrees. With this arrangement the projections bias the lace material into the jaws created by the arm and the body. The lace engaging elements provided on the body can be the peaks of a roughened or corrugated surface adapted to prevent slippage of the lace material.

The laces tying device of the present invention may be further provided with a display portion. The display portion can be adapted to display any number of display elements. In a preferred construction the display portion comprises a tab, which is adapted to receive a resilient cap provided with a display element. The resilient cap can be constructed from a plastics material, and can be adapted to provide a secure fitting to the tab. The display element can take any suitable form, for example a metal badge, a name tag, an advertising or labelling tag, a toy or other trim element. In another embodiment the display portion may be provided with a non-removable display element.

Preferably the components of the laces tying device are constructed from a plastics material, except the springs, which may comprise metal coil springs.

The present invention also provides an article provided with laces and a laces tying device comprising a body provided with one or more apertures adapted to receive the lace with which the device is used, and provided with readily releasable fastening means adapted to fasten the lace in the one or more apertures, and clip means comprising a retaining arm mounted on a spring-loaded hinge provided on the outer surface of the body, said hinge biasing the arm towards the outer surface of the body and the retaining arm being arranged to retain overlapping portions of the lace which, in use, extend from the one or more apertures.

The invention can be performed in various ways, but two embodiments will now be described by way of examples only and with reference to the accompanying drawings, in which.

Figure 1:
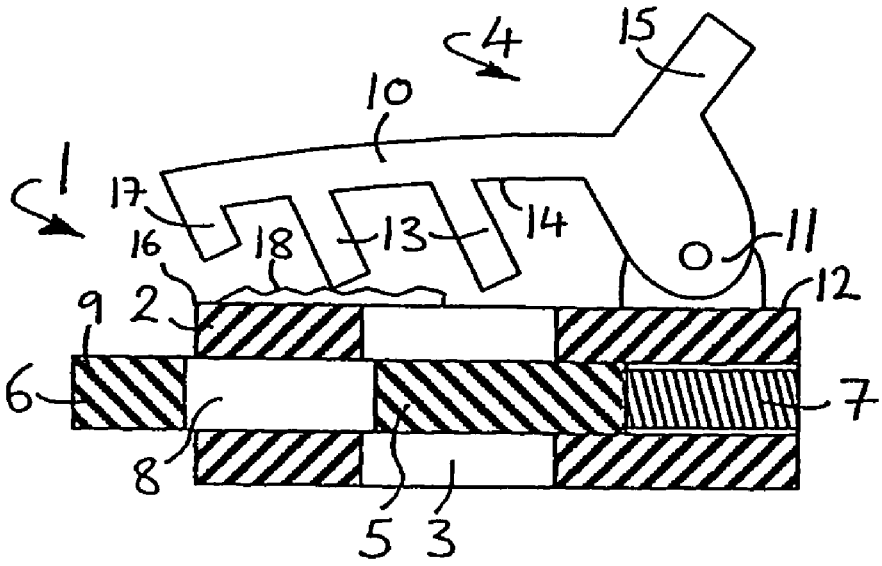
FIG. 1 is a part cross-sectional side view of a first embodiment of laces tying device according to the present invention.
Figure 2:
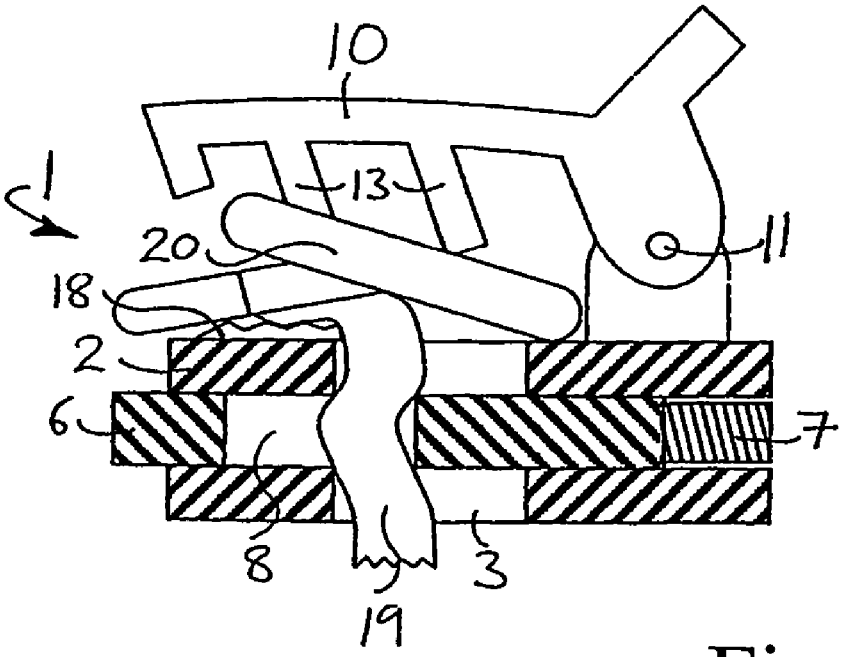
FIG. 2 is a part cross-sectional side view of the laces tying device shown in FIG. 1, when in use.
Figure 3A:
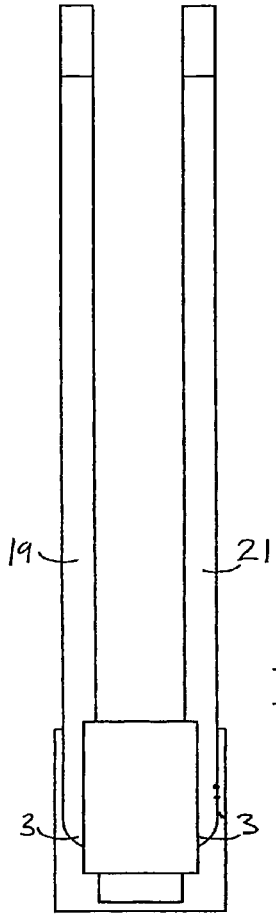
Figure 3B:
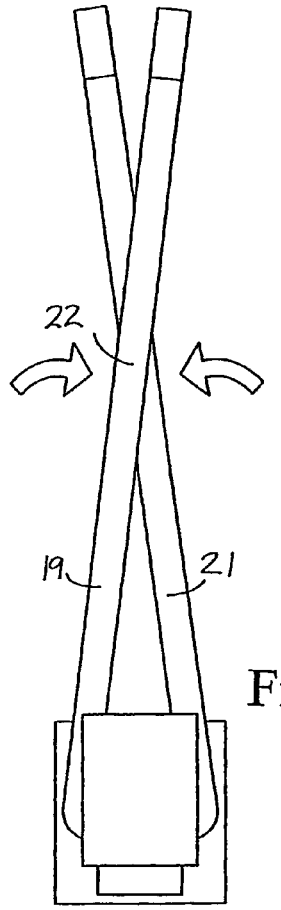
Figure 3C:
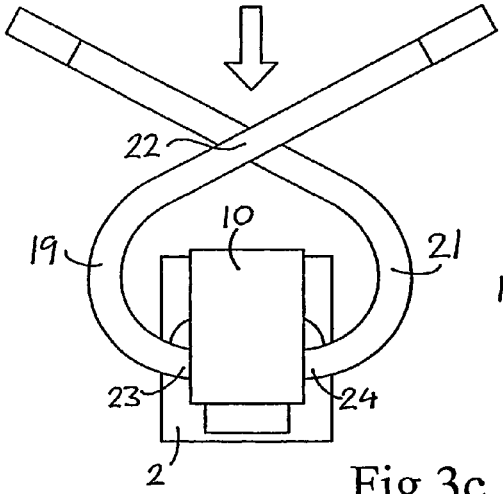
Figure 3D:
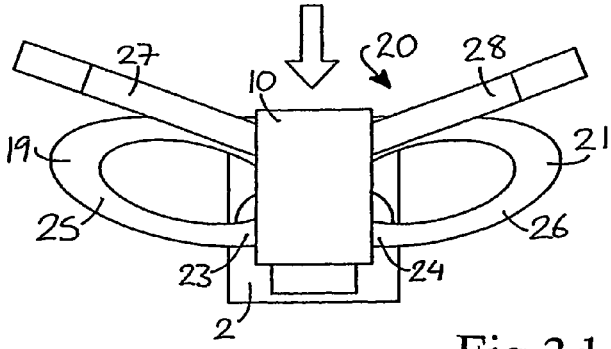
Figure 4:
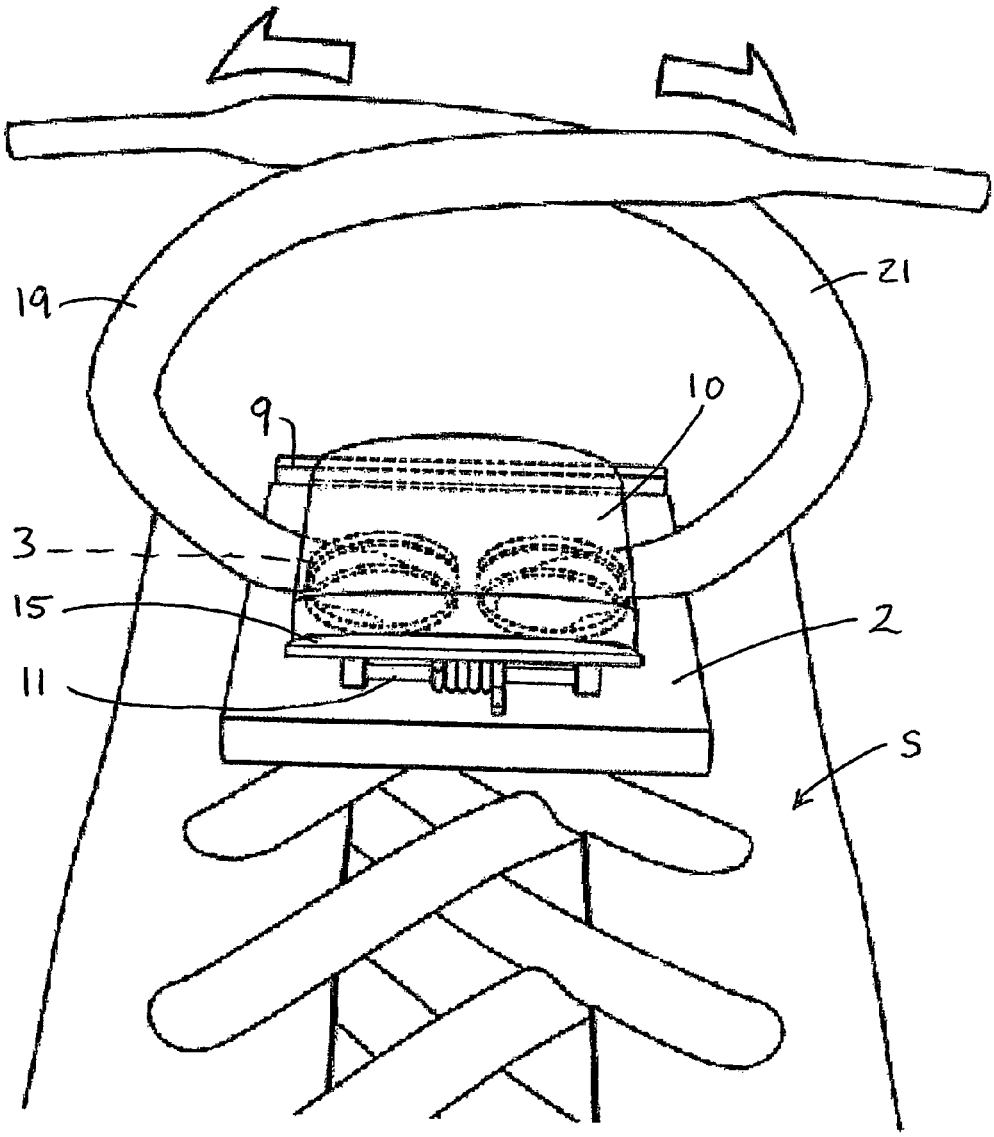
Figure 5:
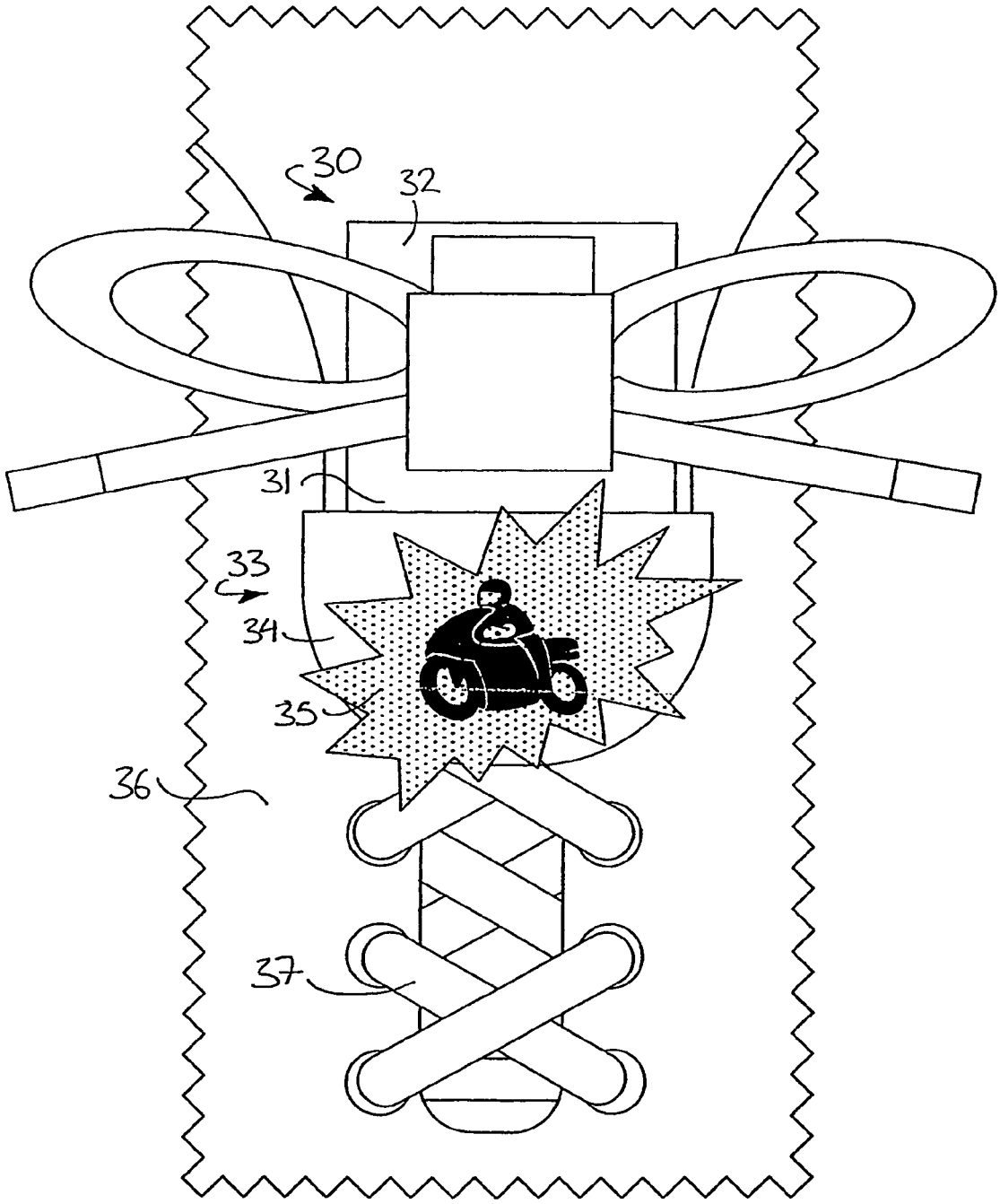

FIGS. 3*a* to 3*d* are top views of the laces tying device of FIG. 1 and shown in use in four successive configurations;

FIG. 4 is a view of the device of FIGS. 1 to 3 shown in use to tie the laces of a shoe; and FIG. 5 is a top view of a second embodiment of laces tying device according to the present invention when in use.

Referring to FIG. 1 of the drawings, there is shown a laces tying device 1 which comprises a body 2 provided with two side-by-side apertures 3 (only one of which is visible), and clip means 4.

The apertures 3 are intersected by a passage 5, which houses a clamp element 6 and a spring 7. The clamp element 6 is provided with two side-by-side apertures 8 (only one of which is visible), which are of corresponding diameter to apertures 3. The spring 7 is connected to the clamp element 6, and biases the clamp element 6 in one direction, so that the apertures 8 are out of alignment with the apertures 3. The clamp element 6 is provided at its forward end with a projecting end or trigger 9, the depression of which displaces the clamp element 6 to bring the apertures 8 and 3 into alignment.

Clip means 4 comprises a retaining arm 10, which is mounted on a spring-loaded hinge 11 provided on the outer surface 12 of the body 2 adjacent its rear end. The arm 10 is biased against the outer surface 12 of the body 2 by the spring loaded hinge 11. The arm 10 is further provided with elongate lace engaging projections 13 on its underside 14, extending across the arm 10. Six projections 13 are preferably provided, but only two shown. The arm 10 is also provided with an operating tab 15 adjacent its rear end.

The arm 10 is formed to an arcuate shape and extends from the top of the hinge 11 towards the foremost edge 16 of the body 2. The arm 10 is further provided, on its underside and at its front end, with an outer lip 17. The projections 13 also extend from the arm 10 at an angle of less than 90 degrees, inclined rearwardly towards the hinge 11. With this arrangement the arm 10 and projections 13 bias the lace material inwardly within the clip means 4.

The upper side of the body 2 is also provided with a lace engaging portion 18 comprising a roughened or corrugated surface, which is adapted to prevent slippage of the lace material.

As shown in FIG. 2, one end portion 19 of a lace has been threaded through apertures 3 and 8 of the device, after depressing the clamp element 6 to bring apertures 3 and 8 into alignment. Once the force depressing clamp element 6 is released, the spring 7 pushes the clamp element 6 to displace its apertures 8 out of alignment with aperture 3, in order to hold the portion 19 in place. A bow 20 has been formed from the portions of lace with extend from the body 2. The bow 20 is held in place by the retaining arm 10, which is held down by the spring-loaded hinge 11. The projections 13 and the portion 18 combine to further retain the bow 20 in position.

FIGS. 3*a* to 3*d* show how the bow 20 was formed. The laces were threaded through the apertures 3 and 8 of the device, until two approximately equal length lace end portions 19 and 21 extend from the body 2. The lace portions 19 and 21 are arranged parallel to one another, as shown in FIG. 3*a*. Then the lace portions 19 and 21 are overlapped once, approximately half way along their length, as shown in FIG. 3*b*. The overlapped portion 22 is then held fast, and the arm 10 is raised by depressing its tab 15. The overlapped portion 22 is then moved under the arm 10 as shown in FIGS. 3*c* and 3*d*. Once the overlapped portion 22 is under the arm 10, the arm 10 is lowered, and the lace portions 19 and 21 are held in place, in the manner of a bow.

It will be appreciated that the above method involved two requirements. First of all, the lace end portions 19 and 21 must be held firmly in place at their bases or inner ends 23 and 24, adjacent the body 2. Secondly, the overlapped portion 22 must be held fast. With these two requirements met, when the overlapped portion 22 is moved towards and under the arm 10, a bow 20 comprising two loops 25 and 26 and two ends 27 and 28 is formed, because the overlapped portion 22 is brought adjacent the bases or inner ends 23 and 24 of the lace end portions 19 and 21.

FIG. 4 shows the device in use to tie the lace on a shoe S.

FIG. 5 shows a lace tying device 30, which is substantially similar in construction to device 1 as shown in FIGS. 1 to 4. However, a display portion 31 is also provided, which extends forwardly from the body 32 of the device 30. A display element 33, comprising a cap 34 and a display member 35, is releasably attached to the display portion 31. The display element 33 can be removed and replaced with any number of alternatives. Other display elements can take any suitable form, for example a metal badge, a name tag, an advertising or labelling tag, a toy or other trim element. In another embodiment (not shown) the display portion is provided with a non-removable display element, or the whole body is shaped and configured to comprise the display portion.

In a further embodiment the arm of the clip means can be adapted to carry a display element, or it can be shaped and patterned to form the display element itself.

As is shown in FIG. 5, the device 30, or the device 1, can be used with a shoe 36 provided with laces 37. It will however be appreciated that the device can be used with any article provided with laces, for example trousers, dresses, coats and so on.

Thus a lace tying device is provided which can tie laces together and form a traditional-shaped bow, without the need to form a conventional knot and bow, which can be difficult for the young, the elderly or the disabled.

The invention claimed is:

1. A laces tying device for tying the ends of a lace having two ends of the lace being threaded into a structure, the structure having an outer surface with opposing portions extending along longitudinal axis of the structure such that opposing portions of the structure are urged toward the axis when the lace ends are pulled, the device comprising: a body provided with one or more apertures in an outer surface thereof adapted to receive the two ends of the lace in the one or more apertures of the body, the apertures extending in a direction generally perpendicular to said opposing portions; a releasable fastening means adapted to fasten the two ends of the lace in the one or more apertures; and clip means comprising a retaining arm mounted on the outer surface of the body such that it extends in parallel with the longitudinal axis, by a hinge with a spring acting around a hinge pin provided on the outer surface of the body, the hinge configured to bias the retaining arm towards the outer surface of the body and over the aperture in the outer surface of the body, the retaining arm being arranged to retain overlapping portions of the two ends of the lace between the retaining arm and the outer surface of the body over the one or more apertures in the body.

2. A laces tying device as claimed in claim 1, in which the one or more apertures are intersected by a passage, the readily releasable fastening means comprising a spring-loaded clamping element.

3. A laces tying device as claimed in claim 2, in which the clamping element is provided with one or more apertures provided in the body.

4. A laces tying device as claimed in claim 3, in which the clamping element is biased in one direction of displacement so that the one or more apertures provided in the clamping element are normally out of alignment with the one or more apertures provided in the body.

5. A laces tying device as claimed in claim 4, in which the clamping element is provided with a trigger, the operation of which displaces the clamping element to bring the one or more apertures provided in the clamping element into alignment with the one or more apertures provided in the body.

6. A laces tying device as claimed in claim 1, in which two apertures are provided in the body, through which the opposite ends of the lace can be threaded.

7. A laces tying device as claimed in claim 6, in which the retaining arm is provided with lace-engaging elements on its underside.

8. A laces tying device as claimed in claim 7, in which the lace engaging elements comprise elongate projections.

9. A laces tying device as claimed in claim 8, in which six elongate projections are provided.

10. A laces tying device as claimed in claim 9, in which the elongate projections extend from the underside of the arm towards the hinge at an angle of less than 90 degrees.

11. A laces tying device as claimed in claim 7, in which the lace engaging elements are provided on the outer surface of the body, adjacent the lace engaging elements provided on the arm.

12. A laces tying device as claimed in claim 11, in which lace engaging elements are provided in the body are formed by a roughened or corrugated surface portion.

13. A laces tying device according to claim 1, further provided with a display portion.

14. A laces tying device according to claim 13, in which the display portion is adapted to display any one of a number of selectable display elements.

15. A laces tying device as claimed in claim 1, in which the tying device is dimensioned for use with footwear provided with laces.

16. An article provided with a fastening using laces and further provided with a laces tying device according to claim 1.

17. A method of using a laces tying device according to claim 1, the method including the steps of:

(a) operating the releasable fastening means and threading the two opposite ends of the lace through the one or more body apertures in the outer surface, then applying the fastening means to fasten the ends of the lace;

(b) arranging the lace ends extending from the one or more body apertures in the outer surface of the body parallel to one another;

(c) overlapping the lace ends at a point approximately half way along their lengths;

(d) opening the clip means and placing the point of overlap of the lace ends under the retaining arm; and (e) closing the retaining arm over the one or more apertures in the outer surface of the body onto the point of overlap of the laces.

18. The laces tying device as claimed in claim 8, in which lace engaging elements are provided on the outer surface of the body, adjacent the lace engaging elements provided on the arm.

19. The laces tying device as claimed in claim 9, in which the lace engaging elements are provided on the outer surface of the body, adjacent the lace engaging elements provided on the arm.

20. The laces tying device as claimed in claim 10, in which the lace engaging elements are provided on the outer surface of the body, adjacent the lace engaging elements provided on the arm.

* * * * *